US011867398B2

(12) United States Patent
Ganiger et al.

(10) Patent No.: US 11,867,398 B2
(45) Date of Patent: Jan. 9, 2024

(54) HOLLOW PLANK DESIGN AND CONSTRUCTION FOR COMBUSTOR LINER

(71) Applicant: General Electric Company, Schenectady, NY (US)

(72) Inventors: Ravindra Shankar Ganiger, Bengaluru (IN); Hiranya Nath, Bengaluru (IN); Daniel J. Kirtley, Blue Ash, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/931,649

(22) Filed: Sep. 13, 2022

(65) Prior Publication Data

US 2023/0366546 A1 Nov. 16, 2023

(30) Foreign Application Priority Data

May 13, 2022 (IN) ..... 202211027572

(51) Int. Cl.

| | |
|---|---|
| ***F23R 3/00*** | (2006.01) |
| ***F23M 5/04*** | (2006.01) |
| *F23R 3/06* | (2006.01) |
| *F23R 3/60* | (2006.01) |
| *F23M 5/08* | (2006.01) |

(52) U.S. Cl.

CPC ..... *F23R 3/002* (2013.01); *F23M 5/04* (2013.01); *F23M 5/085* (2013.01); *F23R 3/06* (2013.01); *F23R 3/60* (2013.01); *F23R 2900/03041* (2013.01); *F23R 2900/03043* (2013.01); *F23R 2900/03044* (2013.01)

(58) Field of Classification Search

CPC .... F23R 3/002; F23R 3/06; F23R 3/60; F23R 2900/03041; F23R 2900/03043; F23R 2900/03044; F23M 5/04; F23M 5/085

See application file for complete search history.

(56) References Cited

U.S. PATENT DOCUMENTS

| | | | |
|---|---|---|---|
| 3,737,152 | A | 6/1973 | Wilson |
| 3,793,827 | A | 2/1974 | Ekstedt |
| 3,811,276 | A | 5/1974 | Caruel et al. |
| 3,845,620 | A | 11/1974 | Kenworthy |
| 4,004,056 | A | 1/1977 | Carroll |
| 4,380,896 | A | 4/1983 | Wiebe |
| 6,155,056 | A | 12/2000 | Sampath et al. |

(Continued)

FOREIGN PATENT DOCUMENTS

| | | |
|---|---|---|
| EP | 0905353 B1 | 1/2003 |
| EP | 2995863 B1 | 5/2018 |

(Continued)

*Primary Examiner* — Gerald L Sung
*Assistant Examiner* — Rene D Ford
(74) *Attorney, Agent, or Firm* — Venable LLP; Michele V. Frank

(57) ABSTRACT

A combustor includes an inner liner and an outer liner defining a combustion chamber. The inner liner includes an inner mesh structure, and a plurality of inner planks mounted to the inner mesh structure. The outer liner includes an outer mesh structure, and a plurality of outer planks mounted to the outer mesh structure. Each of the plurality of inner planks and outer planks includes an inner wall, an outer wall, and lateral walls defining a cavity to allow circulation of airflow within the cavity to cool down the inner wall.

20 Claims, 8 Drawing Sheets

(56) References Cited

U.S. PATENT DOCUMENTS

| | | | |
|---|---|---|---|
| 6,427,446 | B1 | 8/2002 | Kraft et al. |
| 7,017,334 | B2 | 3/2006 | Mayer et al. |
| 7,152,411 | B2 | 12/2006 | McCaffrey et al. |
| 7,219,498 | B2 | 5/2007 | Hadder |
| 7,237,389 | B2 | 7/2007 | Ryan et al. |
| 7,338,244 | B2 | 3/2008 | Glessner et al. |
| 7,389,643 | B2 | 6/2008 | Simons et al. |
| 8,033,114 | B2 | 10/2011 | Hernandez et al. |
| 8,316,541 | B2 | 11/2012 | Patel et al. |
| 8,727,714 | B2 | 5/2014 | Snider et al. |
| 9,080,770 | B2 | 7/2015 | Dudebout et al. |
| 9,127,565 | B2 | 9/2015 | Keller et al. |
| 9,328,665 | B2 | 5/2016 | Doerr et al. |
| 9,341,377 | B2 | 5/2016 | Kramer |
| 9,360,217 | B2 | 6/2016 | DiCintio et al. |
| 9,612,017 | B2 | 4/2017 | Vetters |
| 9,651,258 | B2 | 5/2017 | Graves et al. |
| 9,709,280 | B2 | 7/2017 | Preston, III |
| 9,829,199 | B2 | 11/2017 | Mayer |
| 9,958,159 | B2 | 5/2018 | Smallwood et al. |
| 10,107,128 | B2 | 10/2018 | Romanov et al. |
| 10,378,767 | B2 | 8/2019 | Maurer et al. |
| 10,386,066 | B2 | 8/2019 | Cunha et al. |
| 10,422,532 | B2 | 9/2019 | Sadil et al. |
| 10,451,279 | B2 | 10/2019 | Staufer |
| 10,473,331 | B2 | 11/2019 | Quach et al. |
| 10,563,865 | B2 | 2/2020 | Chang |
| 10,598,382 | B2 | 3/2020 | Tu et al. |
| 10,648,666 | B2 | 5/2020 | Bouldin et al. |
| 10,767,863 | B2 | 9/2020 | Freeman et al. |
| 10,801,730 | B2 | 10/2020 | Kramer |
| 10,801,731 | B2 | 10/2020 | Dillard |
| 10,808,930 | B2 | 10/2020 | Schlichting |
| 10,969,103 | B2 | 4/2021 | Chang et al. |
| 11,015,812 | B2 | 5/2021 | Petty, Sr. et al. |
| 2010/0236250 | A1 | 9/2010 | Headland et al. |
| 2015/0260399 | A1 | 9/2015 | Low |
| 2016/0245518 | A1 | 8/2016 | Drake |
| 2016/0290647 | A1* | 10/2016 | Propheter-Hinckley ..... F23R 3/002 |
| 2016/0370008 | A1* | 12/2016 | Drake ..... F23R 3/06 |
| 2018/0292090 | A1 | 10/2018 | Dyer et al. |
| 2018/0306113 | A1 | 10/2018 | Morton et al. |
| 2020/0116360 | A1 | 4/2020 | White et al. |
| 2020/0348023 | A1 | 11/2020 | Paauwe et al. |
| 2020/0400313 | A1* | 12/2020 | Quach ..... F23R 3/002 |
| 2021/0018178 | A1 | 1/2021 | Sze |
| 2021/0102705 | A1 | 4/2021 | Kramer |
| 2021/0325043 | A1 | 10/2021 | Freeman et al. |

FOREIGN PATENT DOCUMENTS

| | | | |
|---|---|---|---|
| EP | 2868973 | B1 | 12/2018 |
| EP | 3770500 | A1 | 1/2021 |
| EP | 3321586 | B1 | 6/2021 |
| GB | 2432902 | B | 1/2011 |

* cited by examiner

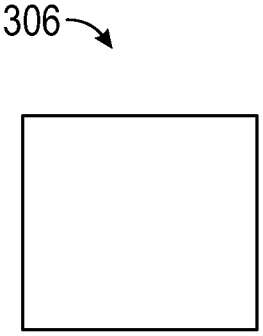
FIG. 8A
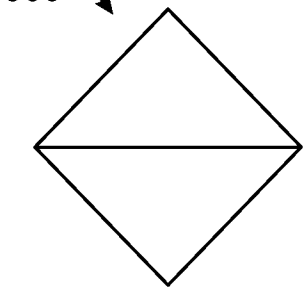
FIG. 8B
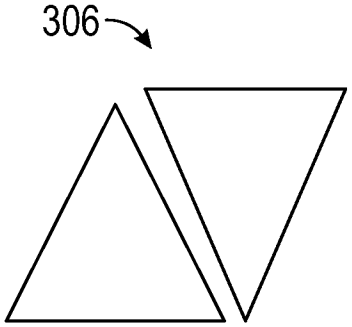
FIG. 8C
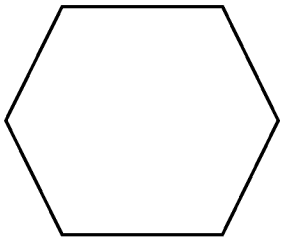
FIG. 8D
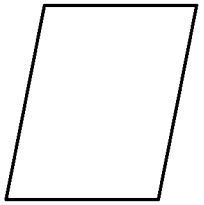
FIG. 8E
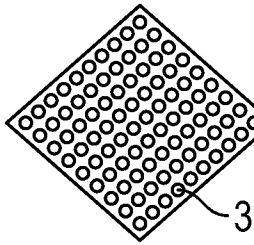
FIG. 9A
FIG. 9B
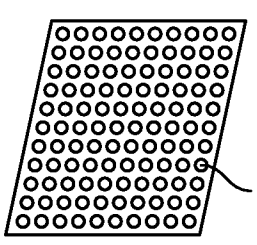
FIG. 9C
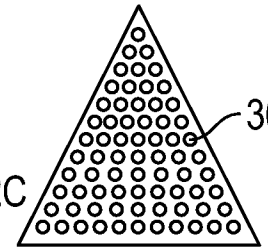
FIG. 9D
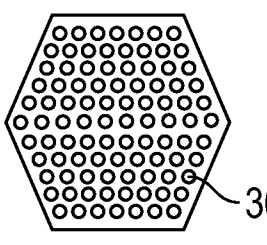
FIG. 9E

HOLLOW PLANK DESIGN AND CONSTRUCTION FOR COMBUSTOR LINER

CROSS REFERENCE TO RELATED APPLICATIONS

The present application claims the benefit of Indian Patent Application No. 202211027572, filed on May 13, 2022, which is hereby incorporated by reference herein in its entirety.

TECHNICAL FIELD

The present disclosure relates generally to combustor liners and, in particular, to a combustor liner having a hollow plank and a skeleton mesh structure.

BACKGROUND

A gas turbine engine generally includes a fan and a core arranged in flow communication with one another, with the core disposed downstream of the fan in the direction of flow through the gas turbine engine. The core of the gas turbine engine generally includes, in serial flow order, a compressor section, a combustion section, a turbine section, and an exhaust section. With multi-shaft gas turbine engines, the compressor section can include a high pressure compressor (HPC) disposed downstream of a low pressure compressor (LPC), and the turbine section can similarly include a low pressure turbine (LPT) disposed downstream of a high pressure turbine (HPT). With such a configuration, the HPC is coupled with the HPT via a high pressure shaft (HPS), and the LPC is coupled with the LPT via a low pressure shaft (LPS). In operation, at least a portion of air over the fan is provided to an inlet of the core. Such a portion of the air is progressively compressed by the LPC and, then, by the HPC until the compressed air reaches the combustion section. Fuel is mixed with the compressed air and burned within the combustion section to produce combustion gases. The combustion gases are routed from the combustion section through the HPT and, then, through the LPT. The flow of combustion gases through the turbine section drives the HPT and the LPT, each of which in turn drives a respective one of the HPC and the LPC via the HPS and the LPS. The combustion gases are then routed through the exhaust section, e.g., to atmosphere. The LPT drives the LPS, which drives the LPC. In addition to driving the LPC, the LPS can drive the fan through a power gearbox, which allows the fan to be rotated at fewer revolutions per unit of time than the rotational speed of the LPS for greater efficiency.

The fuel that mixed with the compressed air and burned within the combustion section is delivered through a fuel nozzle.

BRIEF DESCRIPTION OF THE DRAWINGS

The foregoing and other features and advantages will be apparent from the following, more particular, description of various exemplary embodiments, as illustrated in the accompanying drawings, wherein like reference numbers generally indicate identical, functionally similar, and/or structurally similar elements.

FIGS. 8A to 8E show various geometrical configurations of structural elements of the skeleton mesh structure shown in FIGS. 3 and 4, according to an embodiment of the present disclosure.

FIGS. 9A to 9E show various geometrical configurations of planks of the plurality of hot side planks, according to an embodiment of the present disclosure.

DETAILED DESCRIPTION

Figure 1:
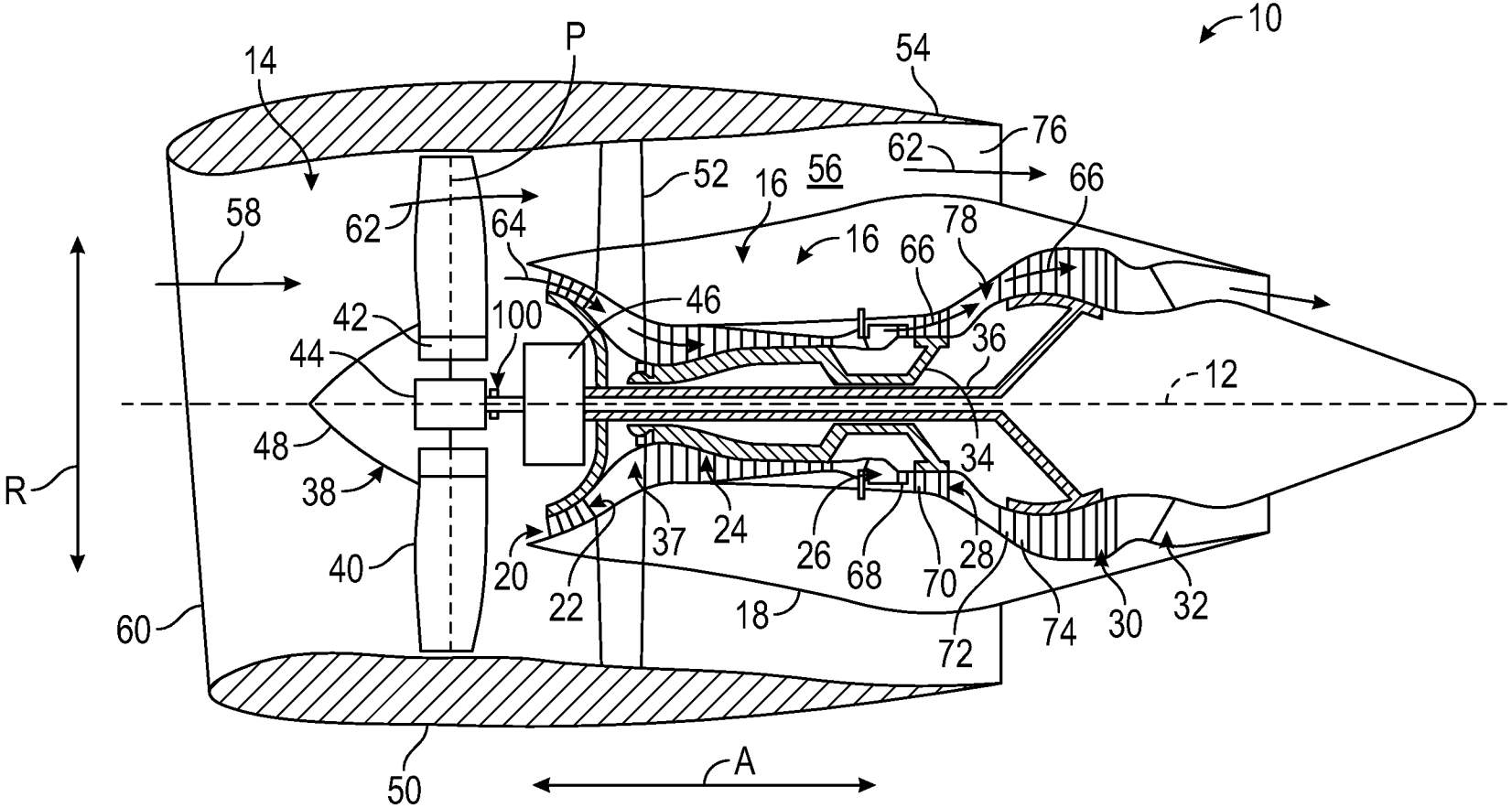
FIG. 1 is a schematic cross-sectional diagram of a turbine engine, according to an embodiment of the present disclosure.

Additional features, advantages, and embodiments of the present disclosure are set forth or apparent from a consideration of the following detailed description, drawings, and claims. Moreover, it is to be understood that both the foregoing summary of the present disclosure and the following detailed description are exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the spirit and the scope of the present disclosure.

In the following specification and the claims, reference may be made to a number of "optional" or "optionally"

elements meaning that the subsequently described event or circumstance may occur or may not occur, and that the description includes instances in which the event occurs and instances in which the event does not occur.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

As used herein, the terms "axial" and "axially" refer to directions and orientations that extend substantially parallel to a centerline of the turbine engine or the combustor. Moreover, the terms "radial" and "radially" refer to directions and orientations that extend substantially perpendicular to the centerline of the turbine engine or the fuel-air mixer assembly. In addition, as used herein, the terms "circumferential" and "circumferentially" refer to directions and orientations that extend arcuately about the centerline of the turbine engine or the fuel-air mixer assembly.

As will be further described in detail in the following paragraphs, a combustor is provided with improved liner durability under harsh heat and stress environment. The combustor includes a skeleton mesh structure (also referred to as a hanger or a truss) on which are mounted an inner liner and an outer liner. The skeleton mesh structure acts as a supporting structure for the inner liner and the outer liner as whole. In an embodiment, the skeleton mesh structure can be made of metal. The skeleton mesh structure together with the inner liner and the outer liner define the combustion chamber. The inner liner and the outer liner include a plurality of planks. The plurality planks cover at least the inner side of the skeleton mesh structure. In an embodiment, the plurality of planks can be made of a ceramic material, a Ceramic Matrix Composite (CMC) material, or a metal coated with CMC or a Thermal Barrier Coating (TBC). In an embodiment, the plurality planks are exposed to hot flames. Each of the plurality of planks is hollow and includes an inner wall and an outer wall. The plurality of planks that are hollow provide liner protection in case of primary face distress due to hot gases. The skeleton mesh structure together with the plurality of planks can improve durability by reducing or substantially eliminating hoop stress while providing a lightweight liner configuration for the combustor. In addition, the use of the plurality of planks together with the skeleton mesh structure provides a modular or a segmented configuration that facilitates manufacturing and/or inspection, servicing and replacement of individual planks.

FIG. 1 is a schematic cross-sectional diagram of a turbine engine 10, according to an embodiment of the present disclosure. More particularly, for the embodiment shown in FIG. 1, the turbine engine 10 is a high-bypass turbine engine. As shown in FIG. 1, the turbine engine 10 defines an axial direction A (extending parallel to a longitudinal centerline 12 provided for reference) and a radial direction R, generally perpendicular to the axial direction A. The turbine engine 10 includes a fan section 14 and a core turbine engine 16 disposed downstream from the fan section 14. The term "downstream" is used herein in reference to air flow direction 58.

The core turbine engine 16 depicted generally includes an outer casing 18 that is substantially tubular and that defines an annular inlet 20. The outer casing 18 encases, in serial flow relationship, a compressor section including a booster or a low pressure compressor (LPC) 22 and a high pressure compressor (HPC) 24, a combustion section 26, a turbine section including a high pressure turbine (HPT) 28 and a low pressure turbine (LPT) 30, and a jet exhaust nozzle section 32. A high pressure shaft (HPS) 34 drivingly connects the HPT 28 to the HPC 24. A low pressure shaft (LPS) 36 drivingly connects the LPT 30 to the LPC 22. The compressor section, the combustion section 26, the turbine section, and the jet exhaust nozzle section 32 together define a core air flow path 37.

For the embodiment depicted, the fan section 14 includes a fan 38 with a variable pitch having a plurality of fan blades 40 coupled to a disk 42 in a spaced apart manner. As depicted, the fan blades 40 extend outwardly from the disk 42 generally along the radial direction R. Each fan blade 40 is rotatable relative to the disk 42 about a pitch axis P by virtue of the fan blades 40 being operatively coupled to a suitable actuation member 44 configured to collectively vary the pitch of the fan blades 40 in unison. The fan blades 40, the disk 42, and the actuation member 44 are together rotatable about the longitudinal centerline 12 (longitudinal axis) by the LPS 36 across a power gear box 46. The power gear box 46 includes a plurality of gears for adjusting or controlling the rotational speed of the fan 38 relative to the LPS 36 to a more efficient rotational fan speed.

The disk 42 is covered by a rotatable front hub 48 aerodynamically contoured to promote an air flow through the plurality of fan blades 40. Additionally, the fan section 14 includes an annular fan casing or nacelle 50 that circumferentially surrounds the fan 38 and/or at least a portion of the core turbine engine 16. The nacelle 50 may be configured to be supported relative to the core turbine engine 16 by a plurality of circumferentially-spaced outlet guide vanes 52. Moreover, a downstream section 54 of the nacelle 50 may extend over an outer portion of the core turbine engine 16 so as to define a bypass air flow passage 56 therebetween.

During operation of the turbine engine 10, a volume of air flow 58 enters the turbine engine 10 in air flow direction 58 through an associated inlet 60 of the nacelle 50 and/or the fan section 14. As the volume of air passes across the fan blades 40, a first portion of the air as indicated by arrows 62 is directed or routed into the bypass air flow passage 56 and a second portion of the air as indicated by arrow 64 is directed or routed into the core air flow path 37, or, more specifically, into the LPC 22. The ratio between the first portion of air indicated by arrows 62 and the second portion of air indicated by arrows 64 is commonly known as a bypass ratio. The pressure of the second portion of air indicated by arrows 64 is then increased as it is routed through the HPC 24 and into the combustion section 26, where it is mixed with fuel and burned to provide combustion gases 66.

The combustion gases 66 are routed through the HPT 28 where a portion of thermal energy and/or kinetic energy from the combustion gases 66 is extracted via sequential stages of HPT stator vanes 68 that are coupled to the outer casing 18 and HPT rotor blades 70 that are coupled to the HPS 34, thus, causing the HPS 34 to rotate, thereby supporting operation of the HPC 24. The combustion gases 66 are then routed through the LPT 30 where a second portion of thermal and kinetic energy is extracted from the combustion gases 66 via sequential stages of LPT stator vanes 72 that are coupled to the outer casing 18 and LPT rotor blades 74 that are coupled to the LPS 36, thus, causing the LPS 36 to rotate, thereby supporting operation of the LPC 22 and/or rotation of the fan 38.

The combustion gases 66 are subsequently routed through the jet exhaust nozzle section 32 of the core turbine engine 16 to provide propulsive thrust. Simultaneously, the pressure of the first portion of air 62 is substantially increased as the first portion of air 62 is routed through the bypass air flow passage 56 before it is exhausted from a fan nozzle exhaust section 76 of the turbine engine 10, also providing propulsive thrust. The HPT 28, the LPT 30, and the jet exhaust nozzle section 32 at least partially define a hot gas path 78 for routing the combustion gases 66 through the core turbine engine 16.

The turbine engine 10 depicted in FIG. 1 is, however, by way of example only, and that, in other exemplary embodiments, the turbine engine 10 may have any other suitable configuration. In still other exemplary embodiments, aspects of the present disclosure may be incorporated into any other suitable gas turbine engine. For example, in other exemplary embodiments, aspects of the present disclosure may be incorporated into, e.g., a turboshaft engine, a turboprop engine, a turbo-core engine, a turbojet engine, etc.

Figure 2A:
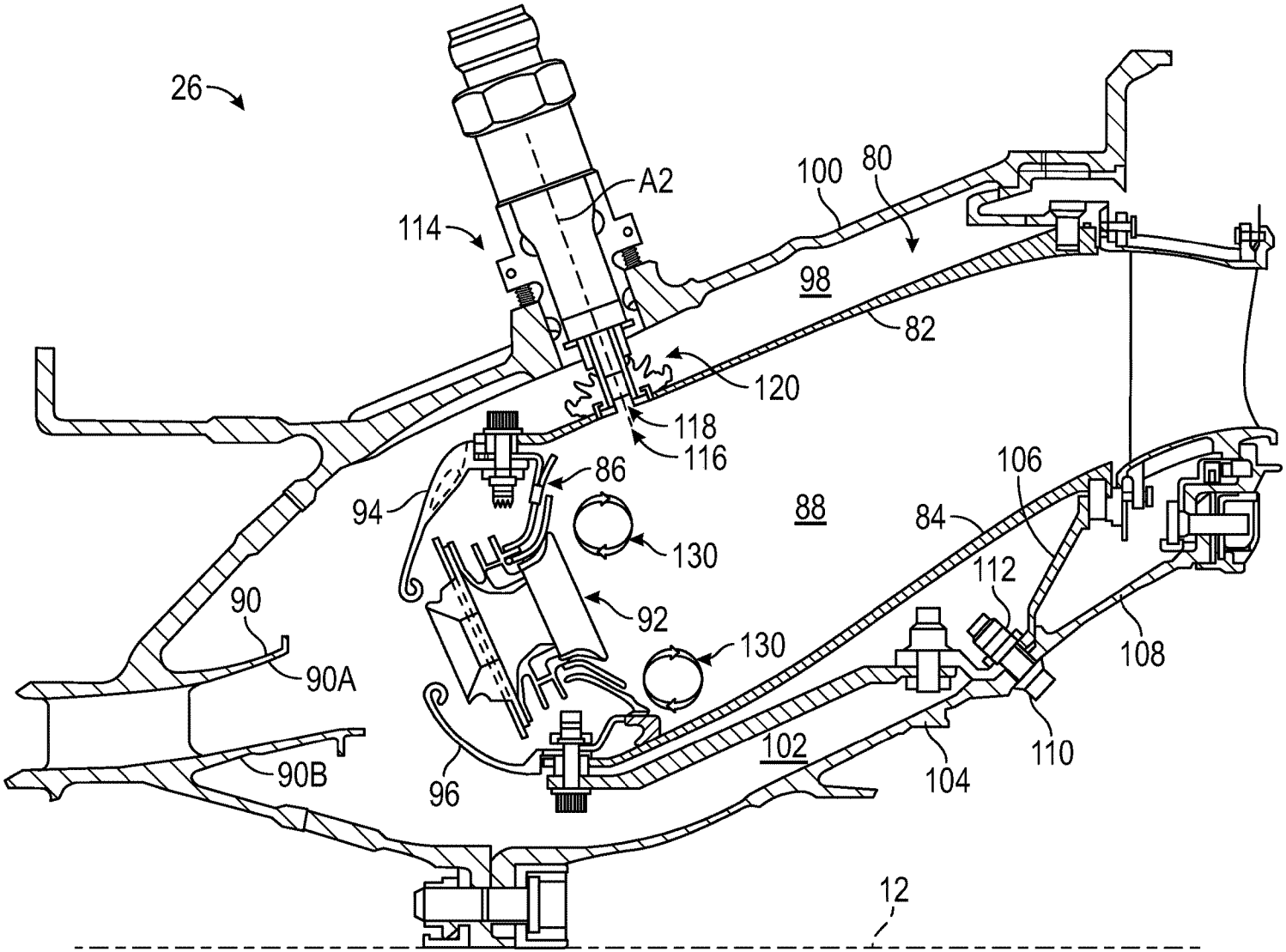
FIG. 2A is a schematic, cross-sectional view of the combustion section of the turbine engine of FIG. 1, according to an embodiment of the present disclosure.

FIG. 2A is a schematic, cross-sectional view of the combustion section 26 of the turbine engine 10 of FIG. 1, according to an embodiment of the present disclosure. The combustion section 26 generally includes a combustor 80 that generates the combustion gases discharged into the turbine section, or, more particularly, into the HPT 28. The combustor 80 includes an outer liner 82, an inner liner 84, and a dome 86. The outer liner 82, the inner liner 84, and the dome 86 together define a combustion chamber 88. In addition, a diffuser 90 is positioned upstream of the combustion chamber 88. The diffuser 90 has an outer diffuser wall 90A and an inner diffuser wall 90B. The inner diffuser wall 90B is closer to a longitudinal centerline 12. The diffuser 90 receives an air flow from the compressor section and provides a flow of compressed air to the combustor 80. In an embodiment, the diffuser 90 provides the flow of compressed air to a single circumferential row of fuel/air mixers 92. In an embodiment, the dome 86 of the combustor 80 is configured as a single annular dome, and the circumferential row of fuel/air mixers 92 is provided within openings formed in the dome 86 (air feeding dome or combustor dome). In other embodiments, however, a multiple annular dome can also be used.

In an embodiment, the diffuser 90 can be used to slow the high speed, highly compressed air from a compressor (not shown) to a velocity optimal for the combustor. Furthermore, the diffuser 90 can also be configured to limit the flow distortion as much as possible by avoiding flow effects like boundary layer separation. Similar to most other gas turbine engine components, the diffuser 90 is generally designed to be as light as possible to reduce weight of the overall engine.

A fuel nozzle (not shown) provides fuel to fuel/air mixers 92 depending upon a desired performance of the combustor 80 at various engine operating states. In the embodiment shown in FIG. 2, an outer cowl 94 (e.g., annular cowl) and an inner cowl 96 (e.g., annular cowl) are located upstream of the combustion chamber 88 so as to direct air flow into fuel/air mixers 92. The outer cowl 94 and the inner cowl 96 may also direct a portion of the flow of air from the diffuser 90 to an outer passage 98 defined between the outer liner 82 and an outer casing 100 and an inner passage 102 defined between the inner liner 84 and an inner casing 104. In addition, an inner support cone 106 is further shown as being connected to a nozzle support 108 using a plurality of bolts 110 and nuts 112. However, other combustion sections may include any other suitable structural configuration.

The combustor 80 is also provided with an igniter 114. The igniter 114 is provided to ignite the fuel/air mixture supplied to combustion chamber 88 of the combustor 80. The igniter 114 is attached to the outer casing 100 of the combustor 80 in a substantially fixed manner. Additionally, the igniter 114 extends generally along an axial direction A2, defining a distal end 116 that is positioned proximate to an opening in a combustor member of the combustion chamber 88. The distal end 116 is positioned proximate to an opening 118 within the outer liner 82 of the combustor 80 to the combustion chamber 88.

In an embodiment, the dome 86 of the combustor 80 together with the outer liner 82, the inner liner 84 and fuel/air mixers 92 forms the combustion chamber provide a swirling flow 130. The air flows through the fuel/air mixer assembly 92 as the air enters the combustion chamber 88. The role of the dome 86 and fuel/air mixer assembly 92 is to generate turbulence in the air flow to rapidly mix the air with the fuel. The swirler (also called mixer) establishes a local low pressure zone that forces some of the combustion products to recirculate, as illustrated in FIG. 2, creating needed high turbulence.

Figure 2B:
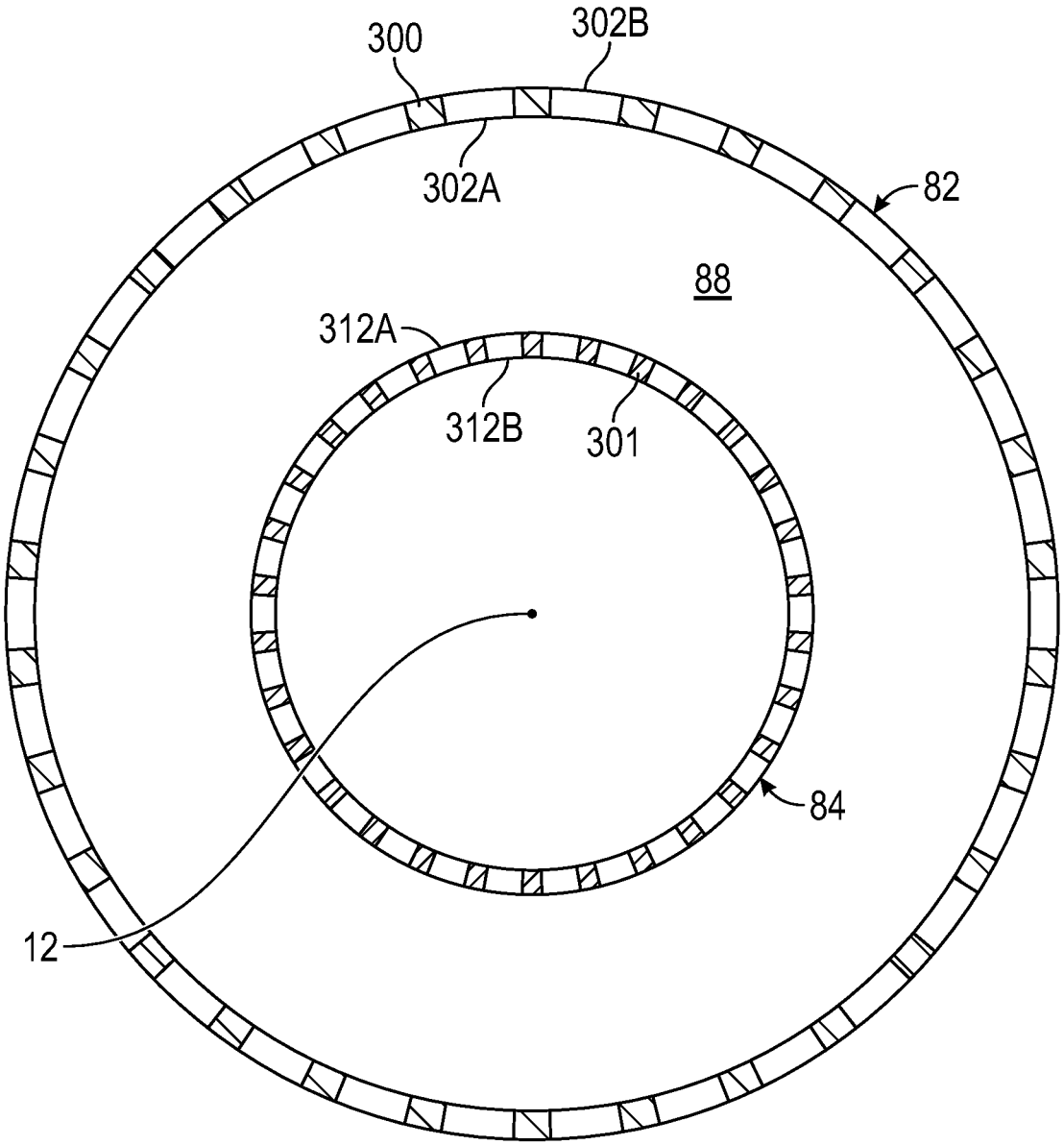
FIG. 2B is a schematic transverse cross-sectional view of the combustor of the turbine engine of FIG. 1, according to an embodiment of the present disclosure.

FIG. 2B is a schematic transversal cross-sectional view of the combustor 80 of the turbine engine 10 of FIG. 1, according to an embodiment of the present disclosure. The combustor 80 includes the outer liner 82 and the inner liner 84 which extend around the turbine centerline 12 to define the combustion chamber 88. The outer liner 82 includes a skeleton mesh structure 300 (also referred to as a hanger or a truss) and a plurality of hot side planks 302A and a plurality of cold side planks 302B. The plurality of hot side planks 302A and the plurality of cold side planks 302B are mounted to the skeleton mesh structure 300 (outer mesh structure) of the outer liner 82. The inner liner 84 includes the skeleton mesh structure 301 (inner mesh structure) and a plurality of hot side planks 312A and a plurality of cold side planks 312B. The plurality of hot side planks 312A and the plurality of cold side planks 312B are mounted to the skeleton mesh structure 301 of the inner liner 84. The skeleton mesh structure 300 acts as a supporting structure for the hot side planks 302A and the cold side planks 302B of the outer liner 82. The skeleton mesh structure 301 acts as a supporting structure for the hot side planks 312A and the cold side planks 312B of the inner liner 84. In an embodiment, the skeleton mesh structures 300 and 301 are made of metal.

The plurality of hot side planks 302A are mounted to and cover the inner side of the skeleton mesh structure 300, and the cold side planks 302B are mounted to and cover the outer side of the skeleton mesh structure 300. In this regard, the plurality of hot side planks 302A and the plurality of cold side planks 302B may be sized and shaped to mesh or connect together and have abutting edges without gaps between adjacent planks 302A, 302B. In other embodiments, gaps may be provided between adjacent planks 302A, 302B. The plurality of hot side planks 312A are mounted to and cover the outer side of the skeleton mesh structure 301, and the cold side planks 312B are mounted to and cover the inner side of the skeleton mesh structure 301. In this regard, the plurality of hot side planks 312A and the plurality of cold side planks 312B may be sized and shaped to mesh or connect together and have abutting edges without gaps between adjacent planks 312A, 312B. In other embodiments, gaps may be provided between adjacent planks 312A, 312B. The plurality of hot side planks 302A of the outer liner 82 and the plurality of hot side planks 312A of the inner liner 84 are exposed to hot flames within the combustion chamber 88. In an embodiment, the plurality of hot side planks 302A, 312A are made of ceramic or are made of metal coated with a ceramic coating or thermal barrier coating to enhance resistance to relatively high temperatures. In an embodiment, the plurality of hot side planks 302A, 312A can be made of a ceramic material, a Ceramic Matrix Composite (CMC) material, or a metal coated with CMC or thermal barrier coating (TBC). In an embodiment, the cold side planks 302B, 312B can be made of a metal or a Ceramic Matrix Composite (CMC). In an embodiment, the cold side planks 302B, 312B are thinner than the plurality of hot side planks 302A, 312A. In an embodiment, as shown in FIG. 2B, both the inner liner 84 and the outer liner 82 are shown having the plurality of hot side planks 302A, 312A and the plurality of cold side planks 302B, 312B. In another embodiment, the plurality of cold side planks 302B, 312B may be optional for the outer liner 82, for the inner liner 84, or for both.

Figure 3:
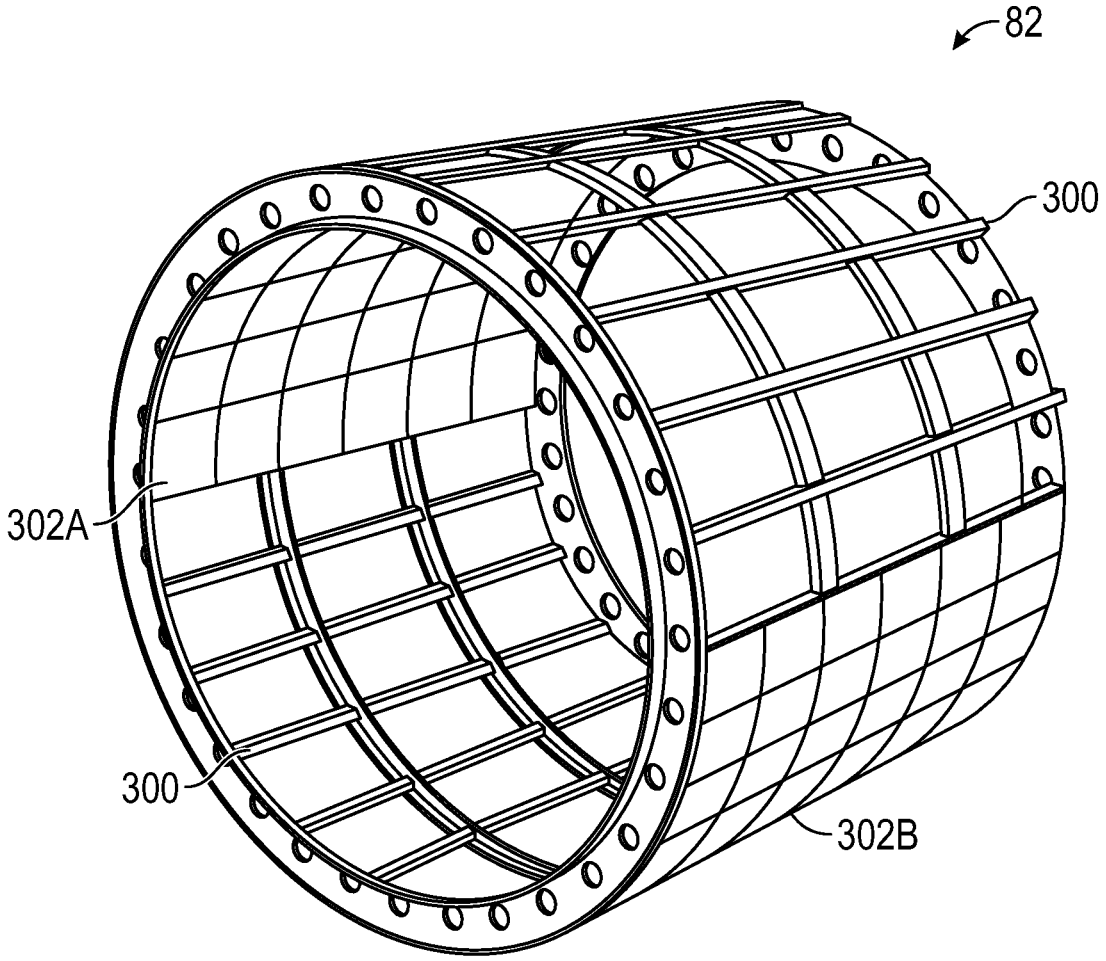
FIG. 3 is a schematic perspective view of a section of the combustor, according to an embodiment of the present disclosure.

FIG. 3 is a schematic perspective view of the outer liner 82 of the combustor 80, according to an embodiment of the present disclosure. In FIG. 3, only the outer liner 82 is shown and the inner liner 84 is omitted in this figure for clarity purposes. The outer liner 82 is shown having generally a cylindrical configuration. The inner liner 84 is similar in many aspects to the outer liner 82. However, the inner liner 84 has a radius of curvature smaller than a radius of curvature of the outer liner 82. As shown in FIG. 3, the outer liner 82 comprises the skeleton mesh structure 300 (outer mesh structure) on which are mounted the plurality of hot side planks 302A and the plurality of cold side planks 302B. The plurality of hot side planks 302A and the plurality of cold side planks 302B are mounted to the skeleton mesh structure 300 of the outer liner 82. The skeleton mesh structure 300 acts as a supporting structure for the hot side planks 302A and the cold side planks 302B of the outer liner 82. In an embodiment, the skeleton mesh structure 300 is made of metal. The plurality of hot side planks 302A are mounted to and cover the inner side of the skeleton mesh structure 300, and the cold side planks 302B are mounted to and cover the outer side of the skeleton mesh structure 300. In this regard, as depicted in FIG. 3, the plurality of hot side planks 302A and the plurality of cold side planks 302B may be sized and shaped to mesh together, and have abutting edges without gaps between adjacent planks 302A and 302B. In other embodiments, gaps may be provided between adjacent planks 302A and 302B.

The skeleton mesh structure 300 together with the plurality of hot side planks 302A and the plurality of cold side planks 302B can improve durability due to hoop stress reduction or elimination while providing a lightweight liner configuration for the combustor 80. Similarly, the skeleton mesh structure 301 together with the plurality of hot side planks 312A and the plurality of cold side planks 312B can improve durability due to hoop stress reduction or elimination while providing a lightweight liner configuration for the combustor 80. For example, the present configuration provides at least twenty percent weight reduction as compared to conventional combustors. Furthermore, the present configuration provides the additional benefit of being modular or segmented and, thus, relatively easy to repair. Indeed, if one or more planks in the plurality of hot side planks 302A, 312A or the plurality of cold side planks 302B, 312B is damaged, only the damaged one or more planks is replaced and not the entire inner liner 84 or the entire outer liner 82. Furthermore, the present configuration lends itself to be relatively easy to inspect and to repair. All these benefits result in overall cost savings. The plurality of hot side planks 302A and the plurality of cold side planks 302B of the outer liner 82 can also be referred to as a plurality of outer planks. The plurality of hot side planks 312A and the plurality of cold side planks 312B of the inner liner 84 can also be referred to as a plurality of inner planks.

Figure 4:
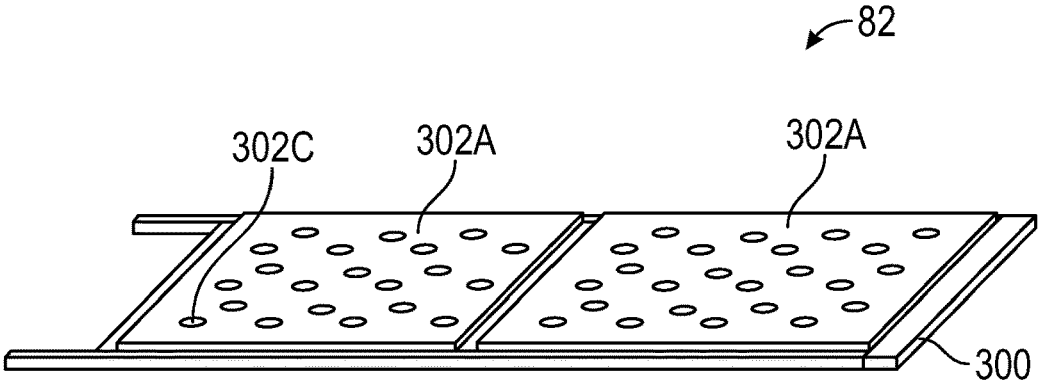
FIG. 4 is a schematic view of a section of the inner liner and the outer liner of the combustor, according to an embodiment of the present disclosure.

FIG. 4 is a schematic view of a section of the outer liner 82 of the combustor 80, according to an embodiment of the present disclosure. Although a section of the outer liner 82 (having the plurality of hot side planks 302A) of the combustor 80 is described herein with reference to FIG. 4, the following description is also applicable to the inner liner 84 (having the plurality of hot side planks 312A) of the combustor 80. As shown in FIG. 4, the plurality of hot side planks 302A are mounted to the skeleton mesh structure 300. The plurality of hot side planks 302A include a plurality of outer holes 302C. The plurality of outer holes 302C are distributed along a surface of the plurality of hot side planks 302A to allow air to enter to the combustion chamber 88.

Figure 5:
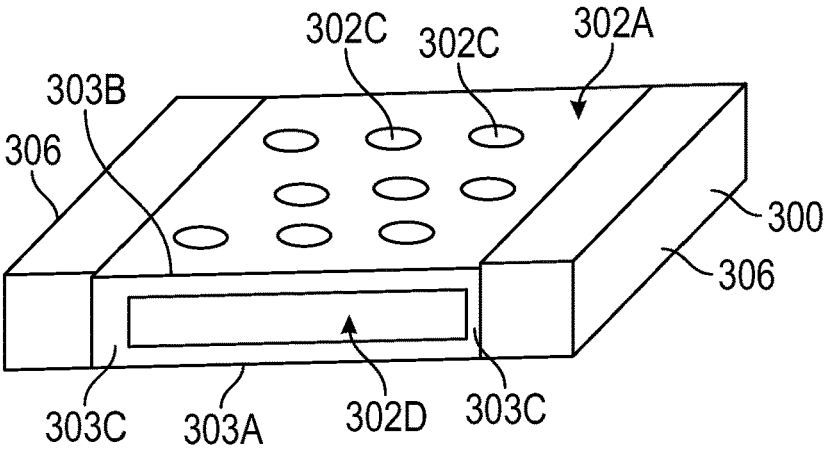
FIG. 5 is a schematic view of one of the plurality of hot side planks mounted to a skeleton mesh structure, according to an embodiment of the present invention.

FIG. 5 is a schematic view of one of the plurality of hot side planks 302A mounted to the skeleton mesh structure 300, according to an embodiment of the present invention. As shown in FIG. 5, each of the plurality of hot side planks 302A is hollow and includes an inner wall 303A, an outer wall 303B, and lateral walls 303C that define a cavity 302D. The plurality of hot side planks 302A that are hollow with the cavity 302D provide liner protection in case of primary face distress due to hot gases. The skeleton mesh structure 300 can include a plurality of structural elements 306 that mesh together to form the skeleton mesh structure 300 shown in FIGS. 3 and 4. Each of the plurality of hot side planks 302A is mounted to the plurality of structural elements 306 of the skeleton mesh structure 300. In an embodiment, the plurality of outer holes 302C in the plurality of hot side planks 302A perforate the outer wall 303B of the plurality of hot side planks 302A. In an embodiment, the plurality of outer holes 302C communicate with the cavity 302D so as to allow airflow from the outer wall 303B through the plurality of outer holes 302C into the cavity 302D and to allow impingement on inner wall 303A and circulation of airflow inside the cavity 302D to cool down the inner wall 303A that faces the combustion chamber 88 (shown in FIGS. 2A and 2B).

In an embodiment, the skeleton mesh structure 300 together with the plurality of hot side planks 302A can improve durability by reducing or substantially eliminating hoop stress while providing a lightweight liner configuration for the combustor 80. In addition, the use of the plurality of hot side planks 302A together with the skeleton mesh structure 300 provides a modular or segmented configuration that facilitates manufacturing and/or inspection, servicing, and replacement of individual planks 302A.

Figure 6A:
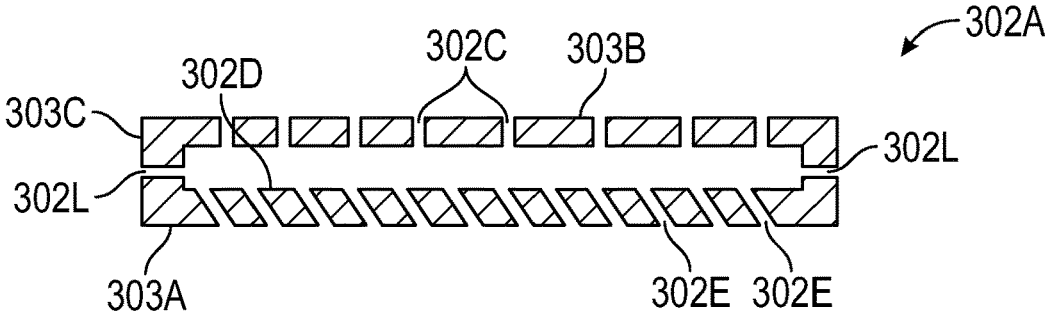
FIG. 6A is a schematic cross-sectional view of one of the plurality of hot side planks showing the arrangement of holes within the plurality of the planks, according to an embodiment of the present disclosure.

FIG. 6A is a schematic cross-sectional view of one of the plurality of hot side planks 302A showing the arrangement of the plurality of outer holes 302C within the plurality of hot side planks 302A, according to an embodiment of the present disclosure. As shown in FIG. 6A, the plurality of hot side planks 302A have the inner wall 303A, the outer wall 303B, and the lateral walls 303C that define a cavity 302D. The plurality of outer holes 302C are provided in the outer wall 303B of the plurality of hot side planks 302A. In addition to the plurality of outer holes 302C, in an embodiment, a plurality of inner holes 302E are provided in the inner wall 303A of the plurality of hot side planks 302A. In an embodiment, the plurality of outer holes 302C in the outer wall 303B of the plurality of hot side planks 302 are orthogonal holes with respect to the outer wall 303B. In an embodiment, the plurality of inner holes 302E in the inner wall 303A of the plurality of hot side planks 302A are oblique holes with respect to the inner wall 303A of the plurality of hot side planks 302A and communicate with the cavity 302D. The oblique holes, also known as multi-holes, are used to form a film of cooling air over the surface of inner wall 303A that faces the hot gases inside the combustion chamber. In an embodiment, the plurality of outer holes 302C have an area Ah1 and the plurality of inner holes 302E have an area Ah2. In addition, to the plurality of outer holes 302C and the plurality of inner holes 302E, the plurality of hot side planks 302A may also include a plurality of lateral holes 302L that are provided in lateral walls 303C and communicate with the cavity 302D. The plurality of outer holes 302C, the plurality of inner holes 302E and the plurality of lateral holes 302L allow airflow to pass therethrough into and out of the cavity 302D to cool the plurality of hot side planks 302.

Figure 6B:
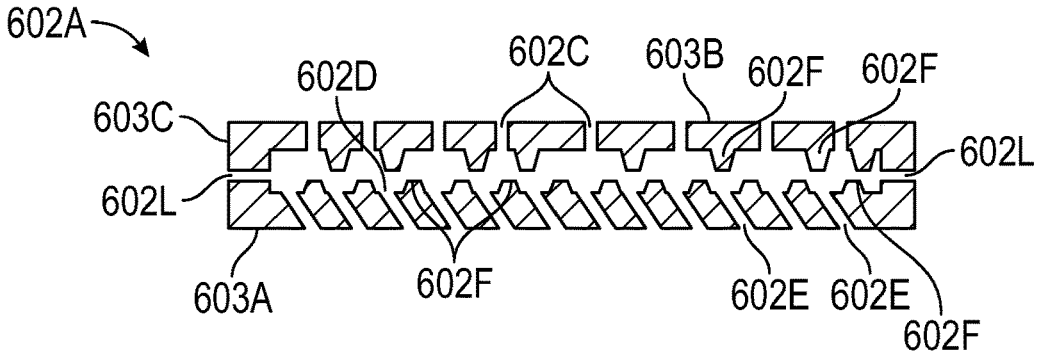
FIG. 6B is a schematic cross-sectional view of one of the plurality of hot side planks showing the arrangement of the plurality of outer holes within the plurality of the hot side planks, according to another embodiment of the present disclosure.

FIG. 6B is a schematic cross-sectional view of one of a plurality of planks 602A showing the arrangement of the plurality of outer holes 602C within the plurality of the planks 602, according to an embodiment of the present disclosure. As shown in FIG. 6B, the plurality of planks 602A have the inner wall 603A, the outer wall 603B, and the lateral walls 603C that define a cavity 602D. The plurality of outer holes 602C are provided in the outer wall 603B of the plurality of planks 602A. In addition to the plurality of outer holes 602C, in an embodiment, a plurality of inner holes 602E are provided in the inner wall 603A of the plurality of planks 602A. In an embodiment, as shown in FIG. 6B, the plurality of planks 602A include a plurality of fins or turbulators 602F. The plurality of fins or turbulators 602F are provided within the cavity 602D of the plurality of planks 602A. The plurality of fins or turbulators 602F are used to create turbulence in the airflow within the cavity 602D. In an embodiment, the plurality of outer holes 602C in the outer wall 603B of the plurality of planks 602A are orthogonal holes with respect to the outer wall 603B. In an embodiment, the plurality of inner holes 602E in the inner wall 603A of the plurality of planks 602 are oblique holes with respect to the inner wall 603A of the plurality of planks 602A and communicate with the cavity 602D. The oblique holes, also known as multi-holes, are used to form a film of cooling air over the surface of inner wall 603A that faces the hot gases inside the combustion chamber. In an embodiment, the plurality of outer holes 602C have an area Ah1 and the plurality of inner holes 602E have an area Ah2. In addition, to the plurality of outer holes 602C and the plurality of inner holes 602E, the plurality of hot side planks 302A may also include a plurality of lateral holes 602L that are provided in lateral walls 603C and communicate with the cavity 602D. The plurality of outer holes 602C, the plurality of inner holes 602E and the plurality of lateral holes 602L allow airflow to pass therethrough into and out of the cavity 602D to cool the plurality of planks 602A.

Figure 6C:
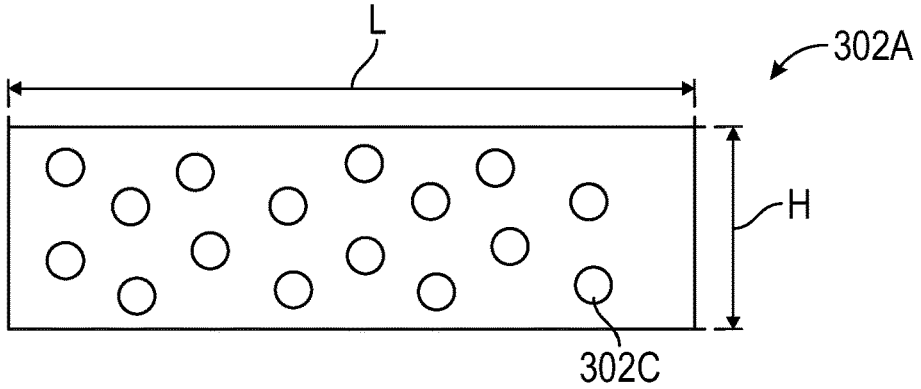
FIG. 6C is a schematic front view of one of the plurality of hot side planks showing the arrangement of holes within the plurality of the hot side planks, according to an embodiment of the present disclosure.

FIG. 6C is a schematic top view of one of the plurality of hot side planks 302A showing the arrangement of the plurality of outer holes 302C within the plurality of the plurality of hot side planks 302A, according to an embodiment of the present disclosure. In an embodiment, as shown in FIG. 6C, the plurality of hot side planks 302A have a rectangular shape with a length L and a height H defining an Area L×H. The plurality of outer holes 302C are distributed on the outer wall 303B of the plurality of hot side planks 302A.

Figure 6D:
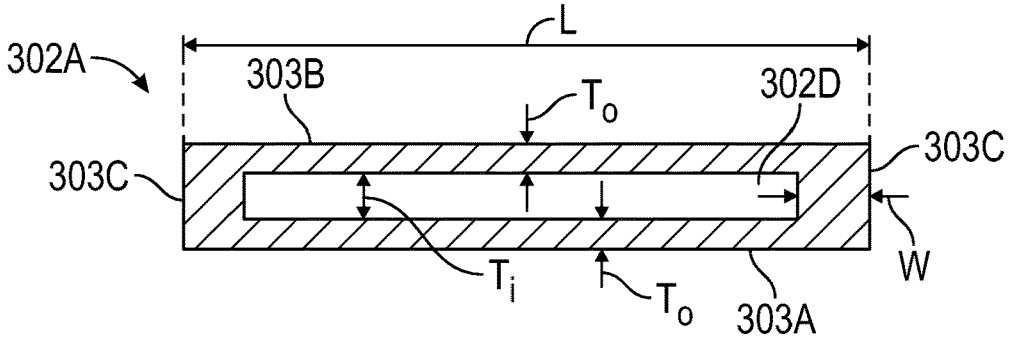
FIG. 6D is a schematic cross-sectional view of one of the plurality of hot side planks showing dimensions of the inner wall and the outer wall, a dimension of the lateral walls, and a dimension of the cavity, according to an embodiment of the present disclosure.

FIG. 6D is a schematic cross-sectional view of one of the plurality of hot side planks 302A showing dimensions of the inner wall 303A and the outer wall 303B, a dimension of the lateral walls 303C, and a dimension of the cavity 302D, according to an embodiment of the present disclosure. In an embodiment, the dimensions (thicknesses) of the inner wall 303A and the outer wall 303B are "To", the dimension (thickness) of the lateral walls 303C is "w", and the dimension (width) of the cavity 302D is "Ti." The total cross-sectional area A1 (including the cavity 302D) can be calculated using equation (1).

$$A1=L\times(2To+Ti) \tag{1}$$

The area A2 of the cavity 302D can be calculated using equation (2).

$$A2=(L-2\times w)\times Ti \tag{2}$$

The ratio of A2/A1 is in the range 0.2 to 0.98. The area of outer cooling holes is Ah1 and the area of inner cooling holes is Ah2. The ratio Ah1/Ah2 is in the range one to two. The cooling effectiveness factor (CEF) is given by equation (3). AP is in the range 1.5% to 3.5%. AP is the air pressure drop across one of the plurality of hot side planks 302A.

$$\mathrm{CEF}=\Delta P\times A2/A1\times Ah1/Ah2 \tag{3}$$

The cooling effectiveness factor is in the range 0.3% to 7%.

Figure 7:
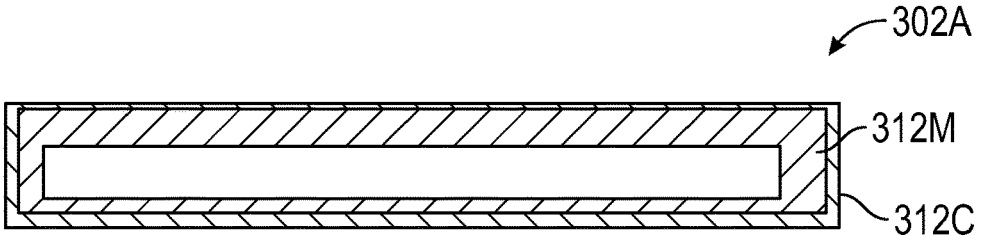
FIG. 7 is a schematic cross-sectional view of one of the plurality of hot side planks showing various layers of materials, according to an embodiment of the present disclosure.

FIG. 7 is a schematic cross-sectional view of one of the plurality of hot side planks 302A showing various layers of materials, according to an embodiment of the present disclosure. As shown in FIG. 7, in an embodiment, the plurality of hot side planks 302A can be made of metal 312M. The metal 312M can be coated with a ceramic material or a Ceramic Matrix Composite (CMC) material 312C or thermal barrier coating (TBC)

FIGS. 8A to 8E show various geometrical configurations of structural elements of the skeleton mesh structure 300 shown in FIGS. 3 and 4, according to an embodiment of the present disclosure. The skeleton mesh structure 300 can include a plurality of structural elements 306 that mesh or connect together to form the skeleton mesh structure 300 shown in FIGS. 3 and 4. As shown in FIGS. 8A to 8E, each of the plurality of structural elements 306 can have any desired geometrical shape, including any polygonal shape such as a square shape or a rectangular shape, a rhombus shape, a triangular shape, a pentagonal shape, a hexagonal shape, or a more complex shape, etc. Each of the structural elements 306 can have a plurality of sides defining a hollow face.

FIGS. 9A to 9E show various geometrical configurations of planks of the plurality of hot side planks 302A, according to an embodiment of the present disclosure. In an embodiment, as shown in FIGS. 9A to 9E, each of the plurality of hot side planks 302A can also have a geometrical shape that matches a corresponding shape of each of the plurality of structural elements 306 shown in FIGS. 8A to 8E. Each of the plurality of hot side planks 302A is essentially a filled or solid shape. The filled shape is provided with a plurality of outer holes 302C. The solid shape (shown in FIGS. 9A to 9E) of each of the plurality of hot side planks 302A can be mounted to a corresponding hollow shape (shown in FIGS. 8A to 8E) of the plurality of structural elements 306. The term "hollow" is used herein to mean that the plurality of structural elements occupy less than 20% of the total area or that the empty or hollow portion is more than 80% of the total area. The plurality of hot side planks 302A can be mounted to the plurality of structural elements 306 of the skeleton mesh structure 300 using various fastening techniques similar to covering, for example, a truss structure of a bridge, a building, aircraft fuselage, rocket structures, etc.

Figure 10A:
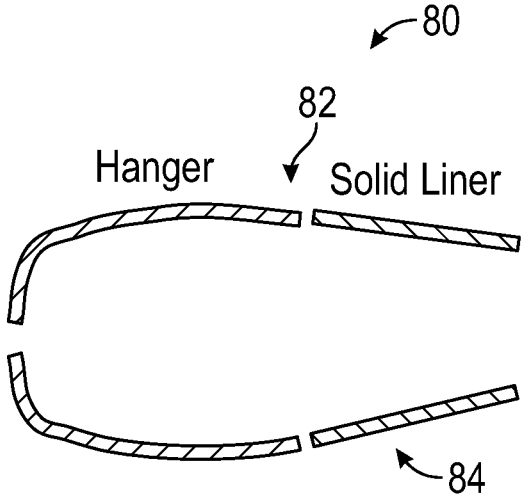
FIGS. 10A and 10B are schematic cross-sectional views of a combustor using the skeleton mesh structure together with the plurality of hot side planks, according to an embodiment of the present disclosure.
Figure 10B:
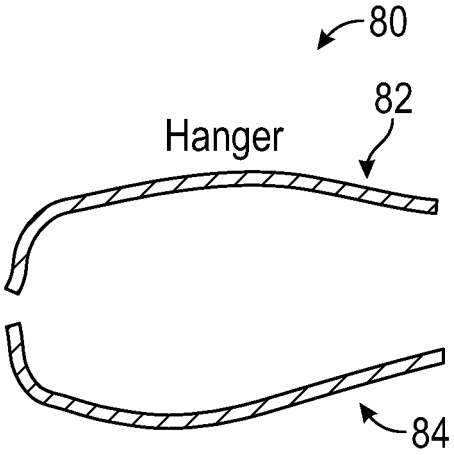

FIGS. 10A and 10B are schematic cross-sectional views of a combustor 80 using the skeleton mesh structure 300 together with the plurality of hot side planks 302A, according to an embodiment of the present disclosure. In FIG. 10A, the inner liner 84 and outer liner 82 of the combustor 80 are composed of forward and aft segments of the respective liner. Forward segment can be of hanger type with a plurality of hot side planks 302A (hollow planks) and the aft segment can be from current art solid liner having an annular gap between the two segments. FIG. 10B shows inner liner 84 and outer liner 82 both made from hanger and hollow plank arrangement.

As can be appreciated from the discussion above, a combustor includes an inner liner and an outer liner defining a combustion chamber. The inner liner includes an inner mesh structure, and a plurality of inner planks mounted to the inner mesh structure. The outer liner includes an outer mesh structure, and a plurality of outer planks mounted to the outer mesh structure. Each of the plurality of inner planks and outer planks comprising an inner wall, an outer wall, and lateral walls defining a cavity to allow circulation of airflow within the cavity to cool down the inner wall.

The combustor according to the above clause, the outer wall including a plurality of outer holes that communicate with the cavity of each of the plurality of inner planks and outer planks.

The combustor according to any of the above clauses, the inner wall including a plurality of inner holes that communicate with the cavity of each of the plurality of inner planks and outer planks.

The combustor according to any of the above clauses, wherein the outer wall includes a plurality of outer holes that communicate with the cavity of each of the plurality of inner planks and outer planks, and the inner wall includes a plurality of inner holes that communicate with the cavity of each of the inner planks and outer planks. The plurality of inner holes in the inner wall of the plurality of inner planks and outer planks are oblique holes with respect to the inner wall of the plurality of inner planks and outer planks, and the plurality of outer holes in the outer wall of the plurality of inner planks and outer planks are orthogonal holes with respect to the outer wall of the plurality of inner planks and outer planks.

The combustor according to any of the above clauses, the lateral walls including a plurality of lateral holes that communicate with the cavity of each of the plurality of inner planks and outer planks.

The combustor according to any of the above clauses, each of the plurality of inner planks and outer planks including a plurality of fins or turbulators provided within the cavity of each of the plurality of inner planks and outer planks.

The combustor according to any of the above clauses, the inner mesh structure and the outer mesh structure including a plurality of structural elements that connect together and having a hollow polygonal shape with a plurality of sides defining a hollow face.

The combustor according to any of the above clauses, the plurality of inner planks and outer planks having a filled polygonal shape that matches the hollow polygonal shape of the plurality of structural elements.

The combustor according to any of the above clauses, the plurality of inner planks and outer planks further including a metal coated with a ceramic coating layer.

The combustor according to any of the above clauses, at least one of the plurality of inner planks and outer planks including one or more metal layer, and one or more ceramic coating layer deposited on opposite surfaces of the one or more metal layer.

Another aspect of the present disclosure is to provide a turbine engine including a combustor. The combustor includes an inner liner and an outer liner defining a combustion chamber. The inner liner includes an inner mesh structure, and a plurality of inner planks mounted to the inner mesh structure. The outer liner includes an outer mesh structure, and a plurality of outer planks mounted to the outer mesh structure. Each of the plurality of inner planks and outer planks comprising an inner wall, an outer wall, and lateral walls defining a cavity to allow circulation of airflow within the cavity to cool down the inner wall.

The turbine engine according to the above clause, the outer wall including a plurality of outer holes that communicate with the cavity of each of the plurality of inner planks and outer planks.

The turbine engine according to any of the above clauses, the inner wall including a plurality of inner holes that communicate with the cavity of each of the inner planks and outer planks.

The turbine engine according to any of the above clauses, the outer wall including a plurality of outer holes that communicate with the cavity of each of the plurality of inner planks and outer planks, and the inner wall including a plurality of inner holes that communicate with the cavity of each of the inner planks and outer planks. The plurality of inner holes in the inner wall of the plurality of inner planks and outer planks are oblique holes with respect to the inner wall of the plurality of inner planks and outer planks, and the plurality of outer holes in the outer wall of the plurality of inner planks and outer planks are orthogonal holes with respect to the outer wall of the plurality of inner planks and outer planks.

The turbine engine according to any of the above clauses, the lateral walls including a plurality of lateral holes that communicate with the cavity of each of the plurality of inner planks and outer planks.

The turbine engine according to any of the above clauses, each of the plurality of inner planks and outer planks including a plurality of fins or turbulators provided within the cavity of each of the plurality of planks.

The turbine engine according to any of the above clauses, the inner mesh structure and the outer mesh structure including a plurality of structural elements that connect together and having a hollow polygonal shape with a plurality of sides defining a hollow face.

The turbine engine according to any of the above clauses, the plurality of inner planks and outer planks having a filled polygonal shape that matches the hollow polygonal shape of the plurality of structural elements.

The turbine engine according to any of the above clauses, the plurality of inner planks and outer planks further including a metal coated with a ceramic coating layer.

The turbine engine according to any of the above clauses, at least one of the plurality of inner planks and outer planks including one or more metal layers, and one or more ceramic coating layers deposited on opposite surfaces of the one or more metal layers.

Although the foregoing description is directed to the preferred embodiments of the present disclosure, other variations and modifications will be apparent to those skilled in the art, and may be made without departing from the spirit or scope of the disclosure. Moreover, features described in connection with one embodiment of the present disclosure may be used in conjunction with other embodiments, even if not explicitly stated above.

We claim:

1. A combustor comprising:

an inner liner and an outer liner defining a combustion chamber therebetween, the inner liner comprising an inner mesh structure, and a plurality of first hot side planks and a plurality of first cold side planks mounted to the inner mesh structure, and the outer liner comprising an outer mesh structure, and a plurality of second hot side planks and a plurality of second cold side planks mounted to the outer mesh structure, wherein each of the plurality of first hot side planks and second hot side planks comprises an inner wall, an outer wall, and lateral walls defining a cavity to allow circulation of airflow within the cavity to cool down the inner wall.

2. The combustor according to claim 1, wherein the outer wall comprises a plurality of outer holes that communicate with the cavity of each of the plurality of first hot side planks and second hot side planks.

3. The combustor according to claim 1, wherein the inner wall comprises a plurality of inner holes that communicate with the cavity of each of the plurality of first hot side planks and second hot side planks.

4. The combustor according to claim 1, wherein the outer wall comprises a plurality of outer holes that communicate with the cavity of each of the plurality of first hot side planks and second hot side planks, the inner wall comprises a plurality of inner holes that communicate with the cavity of each of planks the plurality of first hot side planks and second hot side planks, the plurality of inner holes in the inner wall of the plurality of first hot side planks and second hot side planks are oblique holes with respect to the inner wall of the plurality of first hot side planks and second hot side planks, and the plurality of outer holes in the outer wall of the plurality of first hot side planks and second hot side planks are orthogonal holes with respect to the outer wall of the plurality of first hot side planks and second hot side planks.

5. The combustor according to claim 1, wherein the lateral walls include a plurality of lateral holes that communicate with the cavity of each of the plurality of first hot side planks and second hot side planks.

6. The combustor according to claim 1, wherein each of the plurality of first hot side planks and second hot side planks comprises a plurality of fins or turbulators provided within the cavity of each of the plurality of first hot side planks and second hot side planks.

7. The combustor according to claim 1, wherein the inner mesh structure and the outer mesh structure comprise a plurality of structural elements that connect together and having a hollow polygonal shape with a plurality of sides defining a hollow face.

8. The combustor according to claim 7, wherein the plurality of first hot side planks and second hot side planks have a solid polygonal shape that matches the hollow polygonal shape of the plurality of structural elements.

9. The combustor according to claim 1, wherein the plurality of first hot side planks and second hot side planks further comprise a metal coated with a ceramic or thermal barrier coating layer.

10. The combustor according to claim 1, wherein at least one of the plurality of first hot side planks and second hot side planks comprise one or more metal layer, and one or more ceramic or thermal barrier coating layers deposited on opposite surfaces of the one or more metal layers.

11. A turbine engine comprising:

a combustor comprising:

an inner liner and an outer liner defining a combustion chamber therebetween, the inner liner comprising an inner mesh structure, and a plurality of first hot side planks and a plurality of first cold side planks mounted to the inner mesh structure, and the outer liner comprising an outer mesh structure, and a plurality of second hot side planks and a plurality of second cold side planks mounted to the outer mesh structure, wherein each of the plurality of first hot side planks and second hot side planks comprises an inner wall, an outer wall, and lateral walls defining a cavity to allow circulation of airflow within the cavity to cool down the inner wall.

12. The turbine engine according to claim 11, wherein the outer wall comprises a plurality of outer holes that communicate with the cavity of each of the plurality of first hot side planks and second hot side planks.

13. The turbine engine according to claim 11, wherein the inner wall comprises a plurality of inner holes that communicate with the cavity of each of the plurality of first hot side planks and second hot side planks.

14. The turbine engine according to claim 11, wherein the outer wall comprises a plurality of outer holes that communicate with the cavity of each of the plurality of first hot side planks and second hot side planks, the inner wall comprises a plurality of inner holes that communicate with the cavity of each of the plurality of first hot side planks and second hot side planks, the plurality of inner holes in the inner wall of the plurality of first hot side planks and second hot side planks are oblique holes with respect to the inner wall of the plurality of first hot side planks and second hot side planks, and the plurality of outer holes in the outer wall of first hot side planks and second hot side planks are orthogonal holes with respect to the outer wall of the plurality of first hot side planks and second hot side planks.

15. The turbine engine according to claim 11, wherein the lateral walls include a plurality of lateral holes that communicate with the cavity of each of the plurality of first hot side planks and second hot side planks.

16. The turbine engine according to claim 11, wherein each of the plurality of first hot side planks and second hot side planks comprises a plurality of fins or turbulators provided within the cavity of each of the plurality of first hot side planks and second hot side planks.

17. The turbine engine according to claim 11, wherein the inner mesh structure and the outer mesh structure comprise a plurality of structural elements that connect together and having a hollow polygonal shape with a plurality of sides defining a hollow face.

18. The turbine engine according to claim 17, wherein the plurality of first hot side planks and second hot side planks have a filled polygonal shape that matches the hollow polygonal shape of the plurality of structural elements.

19. The turbine engine according to claim 11, wherein the plurality of first hot side planks and second hot side planks further comprise a metal coated with a ceramic or thermal barrier coating layer.

20. The turbine engine according to claim 11, wherein at least one of the plurality of first hot side planks and second hot side planks comprises one or more metal layers, and one or more ceramic or thermal barrier coating layers deposited on opposite surfaces of the one or more metal layers.

* * * * *